United States Patent [19]

Pudims

[11] Patent Number: 4,556,273

[45] Date of Patent: Dec. 3, 1985

[54] ELECTRICAL WIRING DEVICE WITH CORD GRIP FINGERS HAVING LONGITUDINAL FLEX JOINTS

[75] Inventor: Albert A. Pudims, Stratford, Conn.

[73] Assignee: Westinghouse Electric Corp., Pitsbugh, Pa.

[21] Appl. No.: 631,356

[22] Filed: Jul. 16, 1984

[51] Int. Cl.[4] ..... H01R 13/58

[52] U.S. Cl. ..... 339/103 M

[58] Field of Search ..... 339/103 R, 103 C, 103 M, 339/176 R, 166 R, 195 R, 195 M

[56] References Cited

U.S. PATENT DOCUMENTS 4,304,455 12/1981 McLaughlin et al. ..... 339/103 M
4,310,213 1/1982 Fetterolf et al. ..... 339/103 M

FOREIGN PATENT DOCUMENTS 2033011 1/1972 Fed. Rep. of Germany ... 339/176 R

*Primary Examiner*—Eugene F. Desmond
*Attorney, Agent, or Firm*—G. H. Telfer

[57] ABSTRACT

An electrical wiring device with a cord grip whose grip fingers are longitudinally hinged for circumferential spreading about a contained cord, in addition to being hinged for radially inward movement against a cord, under the force of an apertured cover through which the cord extends.

6 Claims, 2 Drawing Figures

ELECTRICAL WIRING DEVICE WITH CORD GRIP FINGERS HAVING LONGITUDINAL FLEX JOINTS

BACKGROUND AND SUMMARY OF THE INVENTION

This invention relates to electrical wiring devices such as plugs and connectors.

Wiring devices frequently have cord grips to restrain cords whose conductors are connected to contact terminals in the device. The cord grips are generally characterized by a plurality of flexible fingers hinged proximate the outer periphery of the base of the device. The fingers bear against the cord and are held tightly in place upon assembly of a cover element with the base. Examples of the foregoing are contained in Smith U.S. Pat. No. 3,437,980, Apr. 8, 1969 and McLaughlin et al. U.S. Pat. No. 4,304,455, Dec. 8, 1981.

Despite the number and variety of previous cord grips and their general success, there is a need for further alternative and improved arrangements of cord grips in wiring devices for reliable retention of a cord and prevention of the entry of dirt and the like. Devices with those characteristics should desirably be economical both to manufacture and use with a single device accommodating cords of varying sizes.

The invention achieves these purposes in a wiring device of a molded plastic plug or connector body and a molded plastic cover or housing. The cover has an opening through which a conductor is inserted to be wired to terminals in the body. The body has a plurality, such as two, integrally molded extensions or grip fingers designed to restrain the conductor, or the grip fingers may be on a separate molded part, such as a ring, adjacent the body. Assembly screws for joining the body and cover draw them together and apply an inward force on the grip fingers via a cam surface or ramp. The grip fingers restrict the conductor from movement when the assembly screws attain a specific torque level. A key feature of the combination of the invention is that the grip fingers are hinged longitudinally through the center of their individual contact surfaces and can flex to conform to diameters of varied conductor sizes. The grip fingers engage a greater surface area and close off more of the cover opening as compared to previous devices. The ramp surface within the cover serves a two-fold purpose. It applies a force to the grip fingers that restricts the conductor from pulling out and a force that conforms the grip fingers to the diameter of the conductor. Additional aspects of the invention will be discussed in connection with the preferred embodiments hereinafter.

THE DRAWING

FIGS. 1 and 2 are respectively end and sectioned elevation views of a wiring device in accordance with an embodiment of the present invention.

DESCRIPTION OF THE PREFERRED EMBODIMENTS

Figure 1:
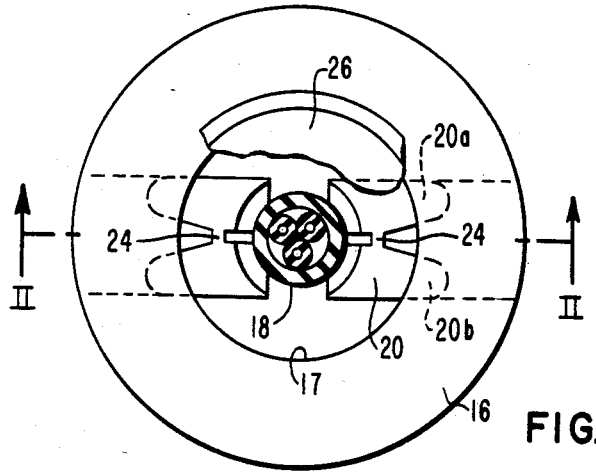
Figure 2:
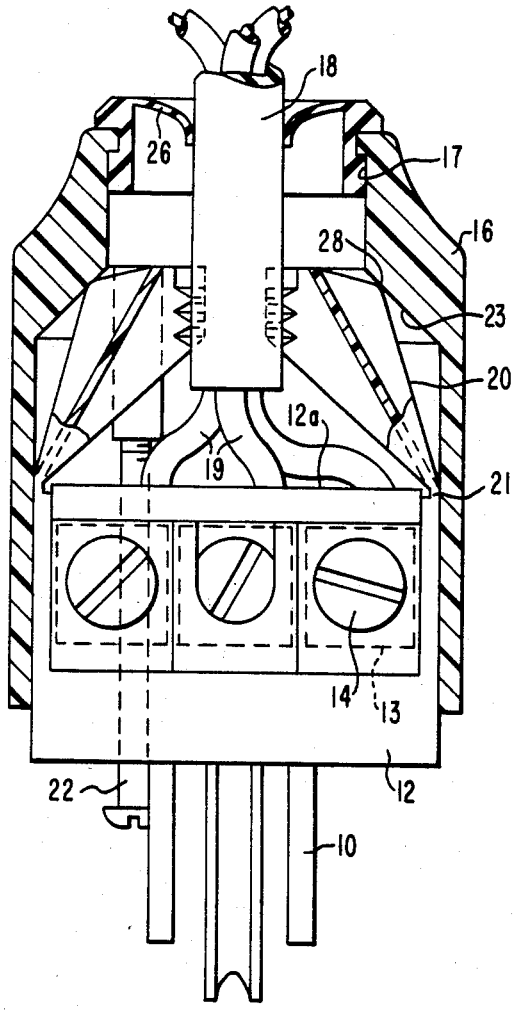

Referring to FIGS. 1 and 2 of the drawing, an electrical wiring device in accordance with the invention is shown. As shown in FIG. 2 the device is a plug with extending male contacts 10 for mating with a connector. However, the device of the invention could also be a connector having internal female contacts with which a plug having contact blades mates. The view of FIG. 1 would be common to both a plug or connector.

The device comprises an insulating body 12, such as of a molded plastic material. The body has a plurality of electrical contact elements 13 supported therein. The contact elements have terminal means 14, such as screws, for attaching conductors respectively thereto. The contacts 13 are not shown in detail; they may be suitably configured in accordance with prior practice.

An insulating cover 16 is disposed over the body 12 and has an aperture 17. The aperture 17 accommodates an electrical line cord 18 which enters within the cover 16 to the space adjacent the body 12 so that the conductors 19 thereof may be attached to the contacts 13 by terminal means 14 on the body.

In this embodiment, a plurality of grip fingers 20 are each joined together at a flexible joint 21 integral with the body 12 at the outer periphery thereof. The fingers 20 are allowed by the flexible joint 21 to move radially toward the line cord 18.

Fastener means such as two diametrically located screw fasteners 22 engage the cover 16 and base 12 together and, as shown in FIG. 2, an inner surface 23 of the cover 16 bears against the fingers 20. When fully assembled by the securing of the fasteners 22, the fingers 20 are forced by the cover 16 into tight engagement with the connected line cord 18. As best shown in FIG. 1, the grip fingers 20 each have a longitudinally running hinge 24 with a portion **20*a* and 20*b* on each side thereof. The hinge 24 permits circumferential spreading of the finger portions 20*a* and 20*b* around the cord 18 under the force of the cover 16** bearing against them.

The circumferential spreading of the finger portions **20*a* and 20*b* helps to provide greater retention force on a cord 18 and also helps to close the upper portion of the device against entry of foreign material. Preferably, also, a dust seal 26 of flexible material is disposed about the aperture through which the cord 18** extends and prevents entry of dirt and the like.

Among variations of the device which may be readily practiced are that the grip fingers 20 need not be integrally molded with the base 12. Instead, they may be molded as a separate element such as a ring which is disposed proximate the periphery of the base with the fingers 20 upstanding therefrom in substantially the same arrangement as shown in FIG. 2.

The device is preferably configured substantially as shown in FIG. 2 in the respect that the fingers 20 have shoulders 28 on each portion **20*a* and 20*b* against which the tapered surface 23 of the cover 16 bears. This provides a concentrated force against the fingers 20** for reliable gripping action.

While variations can be suitably practiced, the device is shown with two grip fingers 20, each of which has two portions **20*a* and 20*b* spaced by a longitudinally extending joint or hinge 24**. This has been found successful so that there is generally no need for additional grip fingers or additional numbers of hinged portions of the fingers although such may be used if desired.

A further aspect of the invention that contributes to its success and utility as a commercially practical device is that the terminals 14 for the internal elements 13 of the body 12 to which the conductors 19 of the cord 18 attach are substantially adjacent each other on one side of the body as illustrated in FIG. 2. More particularly, the body 12 includes a face portion **12*a* with apertures for individual ones of the conductors 19 to come into engagement with respective internal contacts and also has screw terminal means 14 on a side surface of the body for fastening those conductors to the contacts. Each of the internal contacts 13 as well as the screw terminals 14 are insulated from each other by parts of the molded base 12**.

The foregoing embodiments are presented by way of example only and do not limit the application of the invention in other specific forms.

I claim:

1. An electrical wiring device comprising: an insulating body with a plurality of electrical contact elements supported therein and terminal means for attaching conductors respectively thereto;

an insulating cover disposed over said body and having an aperture accommodating an electrical line cord containing conductors attached to said terminal means of said body;

a plurality of grip fingers each joined together at a flexible joint proximate the outer portion of said body for permitting movement of a main finger portion radially inward;

fastener means for longitudinally drawing said cover toward said body with an inner surface of said cover bearing against said fingers to force them into engagement with and restrict the movement of a line cord;

said grip fingers each having a longitudinal hinge with a portion on each side thereof permitting circumferential spreading of said portions around the cord under the force of said cover bearing thereagainst.

2. An electrical wiring device in accordance with claim 1 wherein said fingers and said body are parts of a unitary molded plastic structure.

3. An electrical wiring device in accordance with claim 1 wherein said finger portions each have a shoulder against which an angularly extending inner surface of said cover bears.

4. An electrical wiring device in accordance with claim 1 wherein the aperture through which the cord extends has therein a flexible dust seal that closes the aperture space between said cord and said cover against entry of foreign material.

5. An electrical wiring device in accordance with claim 1 wherein said terminal means for attaching conductors of said cord respectively to said electrical contact elements of said body are disposed substantially adjacent each other on a single lateral side of said body.

6. An electrical wiring device in accordance with claim 1 wherein:

said fingers and said body are parts of a unitary molded plastic structure;

said finger portions each have a shoulder against which an angularly extending inner surface of said cover bears; and said terminal means for attaching conductors of said cord respectively to said electrical contact elements of said body are disposed substantially adjacent each other on a single lateral side of said body.

* * * * *